US005666018A

United States Patent [19]

Langlois et al.

[11] Patent Number: 5,666,018

[45] Date of Patent: Sep. 9, 1997

[54] CATHODE WITH FAST HEAT SWITCH-ON AND SWITCH-OFF MECHANISM AND GRID-TYPE ELECTRON TUBE INCLUDING SUCH A CATHODE

[75] Inventors: Michel Langlois, Concise/Thonon; Robert Frossard, Thonon, both of France

[73] Assignee: Thomson Tubes Electroniques, Velizy, France

[21] Appl. No.: 663,592

[22] Filed: Jun. 14, 1996

Related U.S. Application Data

[63] Continuation of Ser. No. 281,171, Jul. 27, 1994, abandoned.

[30] Foreign Application Priority Data

Jul. 27, 1993 [FR] France ..... 93 09230

[51] Int. Cl.[6] ..... H01J 1/88

[52] U.S. Cl. ..... 313/278; 313/618

[58] Field of Search ..... 313/292, 30, 618, 313/278, 356

[56] References Cited

U.S. PATENT DOCUMENTS

| | | | |
|---|---|---|---|
| 2,608,667 | 8/1952 | Werner | 313/278 |
| 2,683,237 | 7/1954 | Scullin | 313/278 |
| 3,218,502 | 11/1965 | Freggens | 313/278 |
| 3,407,328 | 10/1968 | Kendall, Jr. . | |
| 3,419,743 | 12/1968 | Kaiser et al. | 313/278 |
| 3,449,616 | 6/1969 | Sarrois . | |
| 3,517,249 | 6/1970 | Uchimaru et al. | 313/278 |
| 3,522,467 | 8/1970 | Baker | 313/278 |
| 3,806,753 | 4/1974 | Van Warmerdam | 313/278 |
| 4,563,609 | 1/1986 | Clerc et al. . | |

FOREIGN PATENT DOCUMENTS 1 222 875 2/1971 United Kingdom .

*Primary Examiner*—Sandra L. O'Shea
*Assistant Examiner*—Matthew J. Esserman
*Attorney, Agent, or Firm*—Oblon, Spivak, McClelland, Maier & Neustadt, P.C.

[57] ABSTRACT

An electron tube cathode has a hollow cylindrical structure formed by thermo-emissive wires mounted between two conductive supports. The two supports are mechanically fixed to each other. To prevent the deformation of the cathode when the heating is turned on and turned off, at least one spring is used, this spring being integrated with one of the supports and being placed in the vicinity of the thermo-emissive wires. The spring is made of a material possessing elastic properties which, at ambient temperature, are lower than or equal to the properties that it has at a temperature greater than ambient temperature.

15 Claims, 4 Drawing Sheets

CATHODE WITH FAST HEAT SWITCH-ON AND SWITCH-OFF MECHANISM AND GRID-TYPE ELECTRON TUBE INCLUDING SUCH A CATHODE

This application is a Continuation of application Ser. No. 08/281,171 , filed on Jul. 27, 1994, now abandoned.

BACKGROUND OF THE INVENTION

1. Field of the Invention

The present invention relates to a cathode for a grid-type electron tube that can take fast switching-on and switching-off of the heating voltage.

2. Description of the Prior Art

The cathodes of grid-type electron tubes are mainly directly heated cathodes. They often take the form of a cylindrical meshwork formed by two sheets of crossed wires soldered to each other. The wires are often made of thoriated tungsten. The meshwork is mounted between two supports used to lead in the heating current. The supports are formed by solid metal parts. They are rigidly fixed to the external connections of the tube, at the base Of the tube.

Other cathodes, now less frequently used, have substantially parallel wires fixed between the two supports instead of having a meshwork with crossed wires.

When the heating of this type of cathode is suddenly turned on, the wires of the cathode, which have low thermal inertia, expand as soon as the heating voltage appears. The solid metal supports expand at a slower rate. The time constant is of the order of 1 second for the cathode wires and 1 minute for the support. The cathode wires then undergo a compressive stress.

When the heating is suddenly cut off, the reverse phenomenon occurs. The cathode wires shrink at far greater speed than do the supports. The cathode wires then undergo tensile stresses. These differences in expansion ultimately cause the permanent and irreversible deformation of the cathode wires and they may then affect the control grid. This may prompt electrical sparking or short circuits between the cathode and the grid and the breaking of the tube supply circuit.

The ON-OFF cycles ultimately damage the cathode and considerably reduce the lifetime of the tube.

Solutions have already been proposed with a view to overcoming this drawback.

The heating voltage can be applied and cut off gradually or in stages. This approach has the advantage of enabling the support and the cathode wires to compensate for the differences in expansion. However, in this approach, a non-negligible amount of time is needed to reach the working temperature of the cathode. The turning on and turning off operations are not done instantaneously. This is not acceptable in certain applications.

It has also been proposed, generally in the case of cathodes using parallel wires, to interpose a helical type of spring in one of the supports to neutralize the compressive and tensile stresses that arise in the cathode wires. Their deformation is prevented by keeping them in a taut state. This spring, which is made of metal, cannot act appropriately when it is excessively heated. Its modulus of elasticity and its elastic limit deteriorate with the temperature. So that it may remain elastic, it is placed, far from the cathode wires, at the external connections of the tube at the foot of the tube. However, the further it is from the wires the weaker is its compensation effect.

The present invention is aimed at overcoming these problems of deformation of the cathode and proposes a cathode with fast switching-on and switching-off of the heating. The invention consists in using a spring to prevent the deformations of cathode wires and in placing this spring in the vicinity of the cathode wires.

SUMMARY OF THE INVENTION

The present invention proposes a cathode for an electron tube having a hollow cylindrical structure comprising thermo-emissive wires mounted between two conductive supports. The supports are mechanically fixed to each other. At least one spring is integrated with one of the supports to neutralize the tensile and compressive stresses in the wires. The spring is made of a material whose elastic properties, at ambient temperature, are lower than or equal to the properties that it has at a temperature greater than ambient temperature.

The spring may be made of simple or pyrolytic graphite.

The support integrating the spring may be formed by a plate to which there are fixed the thermo-emissive wires and an elongated part, the spring being fixedly joined by one side to the elongated part and by the other side to the plate.

The spring may be shaped like a hollow cylinder and may comprise, crosswise to its axis, an alternating succession of spring portions and guiding portions.

A guiding portion may comprise a solid U-shaped part within which there slides a tongue having an axis parallel to the axis of the cylinder.

A spring portion may have two omega-shaped strips that are placed symmetrically with respect to an axis parallel to the axis of the cylinder and that are opposite to each other by the base of the omega shapes.

In another embodiment, it is advantageous to use two springs working in opposition. These springs may have the shape of a saucer and be opposite to each other by their edges.

The support integrating the springs may have two plates one on top of the other, the first plate being connected to the thermo-emissive wires and the second plate being connected to an elongated part one of the springs may rest by one side on the second plate and by the other side on the first plate and the other spring may rest by one side on the first plate and by the other side on a stop fixedly joined to the second plate. Advantageously, the stop is borne by a centering rod fixed to the second plate. This rod goes through the spring and the first plate.

Since the supports are crossed by a heating current, a conductive element with resistivity lower than that of the spring can short-circuit the spring.

The conductive element may be made of tantalum and may have a stiffness that is low enough for the stiffness of the assembly formed by the conductive element and the spring to be close to that of the spring alone.

BRIEF DESCRIPTION OF THE DRAWINGS

The invention will be understood more clearly from the following description, given by way of a non-restrictive example, and from the appended figures of which.

MORE DETAILED DESCRIPTION

Figure 1:
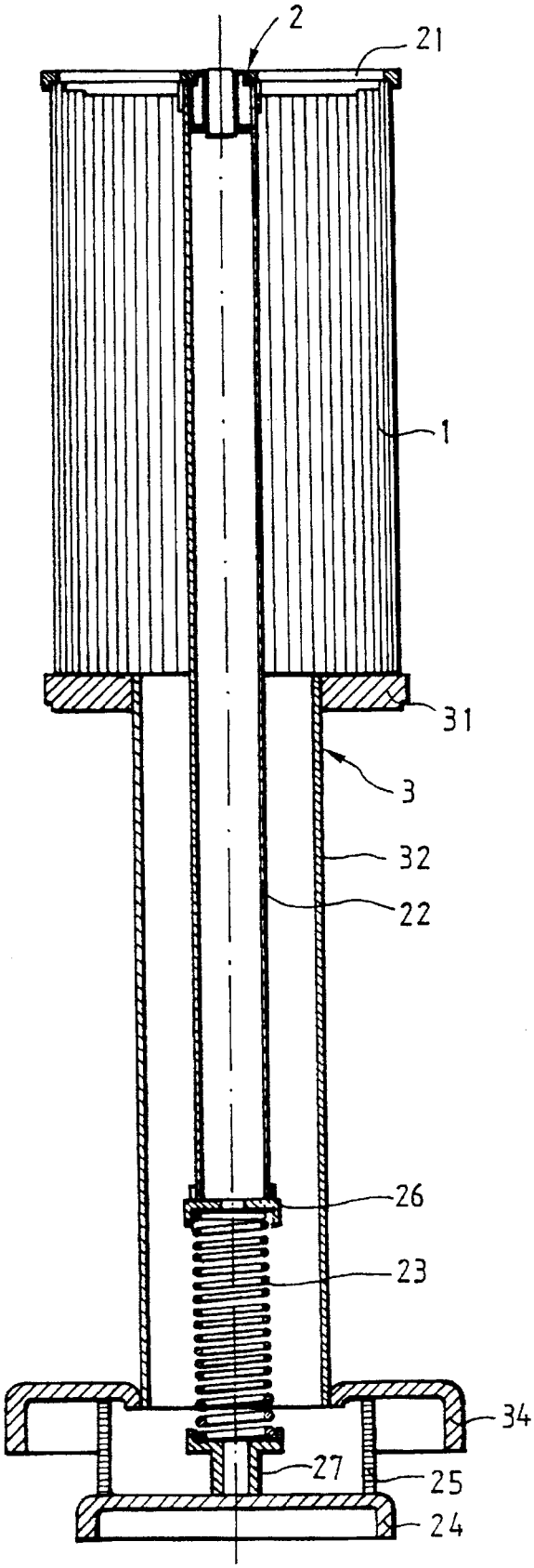
FIG. 1 PRIOR ART
FIG. 1 shows a longitudinal sectional view of a prior art cathode.

The cathode shown in FIG. 1 is a cathode with substantially parallel thermo-emissive wires. It has the shape of a hollow cylinder. The wires have the reference 1. They are fixed between two supports 2 and 3 used as a heating current lead-in elements. The wires 1 demarcate the hollow cylinder.

The upper support 2 has a ring-shaped upper plate 21 and an inner elongated part 22. The wires are mounted on the external side of the ring. The part 22 is a tube fixedly joined by one side to the inner flank of the ring.

The inner tube 22 goes into the cylinder demarcated by the wires 1 of the cathode. The inner tube 22 is extended, at its other end, by a helical spring 23. The spring 23 may be used to lead in heating current but this current may also be conveyed by flexible metal strips. The helical spring 23 ends at a first cathode connection part 24 located at the base of the cathode.

The lower support 3 has a ring-shaped lower plate 31 and an external tube 32. The wires 1 are fixed to the external side of the ring while one end of the external tube 32 is fixedly joined to the internal side of the ring. The other end of the external tube 32 is electrically and mechanically connected to a second cathode connection part 34. The two cathode connection parts 34, 24 are mechanically joined to each, other by an insulating spacer 25. The inner tube 22 and the outer tube 32 are coaxially mounted.

In FIG. 1, the ends of the spring 23 are fixed respectively to an upper base 26 and to a lower base 27 to facilitate the assembly. The upper base 26 is also fixed to the inner tube 22 and the lower base 27 is fixed to the first cathode connection part 24.

The spring 23 is generally made of metal such as steel. It is designed to neutralize the tensile and compressive stresses undergone by the cathode wires both when the heat is turned on and when it is turned off. The spring 23 is placed close to the connection parts 24, 34 so that it does not get heated excessively when the cathode is in operation. Indeed, the metal used has elastic properties that deteriorate with the increase in temperature. The trade-off here, however, is that the greater the distance of the spring 23 from the cathode wires 1, the greater is the extent to which these cathode wires 1 are subjected to variations of position and the lower is the efficiency of the spring action.

Since the spring is a helical spring, there is a risk of its introducing torsion stresses into the supports and into the wires, and this risks aggravating the positioning variations. Furthermore, it makes it difficult to center the cathode with respect to the grid that surrounds it (the grid is not shown herein).

Figure 2:
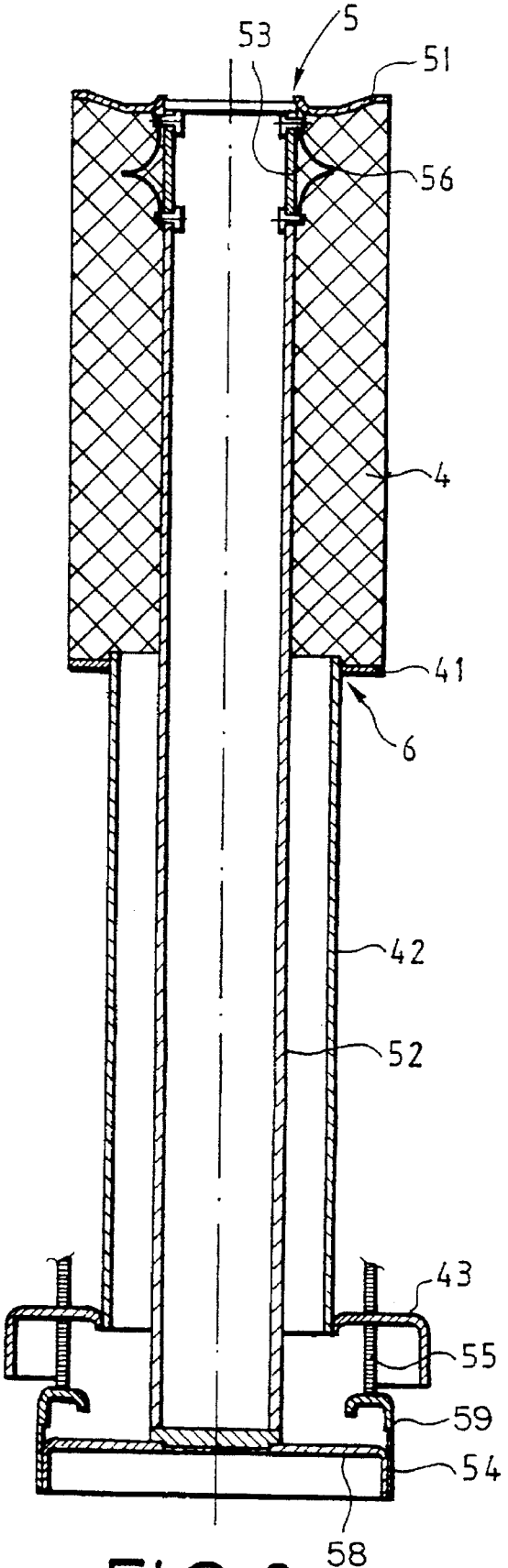
FIG. 2 shows a longitudinal sectional view of a cathode according to the invention.

FIG. 2 shows a sectional view of a cathode according to the invention. Here, it is a meshed cathode. It is cylindrical. It is made out of a meshwork 4 of thermo-emissive wires shaped in the, form of a hollow cylinder. The meshwork 4 is mounted between two solid supports 5, 6 that are also used to lead in heating current. The lower support 6 has a ring-shaped lower plate 41 and an external tube-shaped elongated part 42. The meshwork 4 is fixed to the external flank side of the ring 41 while one end of the external tube 42 is fixed to the internal flank side of the ring 41. The other end of the external tube 42 is electrically and mechanically joined to a first connection part 43 of the cathode.

The upper support 5 has a rod-shaped or tube-shaped elongated part 52 extended by a cylindrical spring 53, the spring 53 being fixedly joined to an upper ring-shaped plate 51. Here, the elongated part is an inner tube 52. The spring 53 is fixed to the inner flank of the ring 51 while the meshwork 4 is fixed to the ring 51 on its outer flank side. The inner tube 52 and the outer tube 42 are coaxially mounted. The base of the inner tube 52 is electrically and mechanically fixed to a first portion 58 of a second cathode connection part 54. The first cathode connection part 43 and a second portion 59 of the second part 54 are mechanically joined by means of an insulating spacer 55. Now, the spring 53 is placed in a zone where it gets heated. It is close to the cathode wire. In the figure, it is even inside the hollow cylinder demarcated by the meshwork 4. So that it can continue to neutralize the tensile and compressive stresses that arise between the supports 41, 51, the spring 53 has been made of a graphite material whose elastic properties do not deteriorate when the temperature rises. The graphite is made of an appropriate material. The elastic properties are the modulus of elasticity and the elastic limit. The graphites used may be simple or pyrolyric graphites. Pyrolytic graphite is a crystallized graphite obtained by the thermal decomposition of a gaseous hydrocarbon on the surface of a material taken to very high temperature. A graphite layer is thus deposited. The direction parallel to the plane of deposition is called the direction AB. The elastic limit of pyrolytic graphite increases with the temperature in the direction AB while its modulus of elasticity remains substantially constant.

Figure 3:
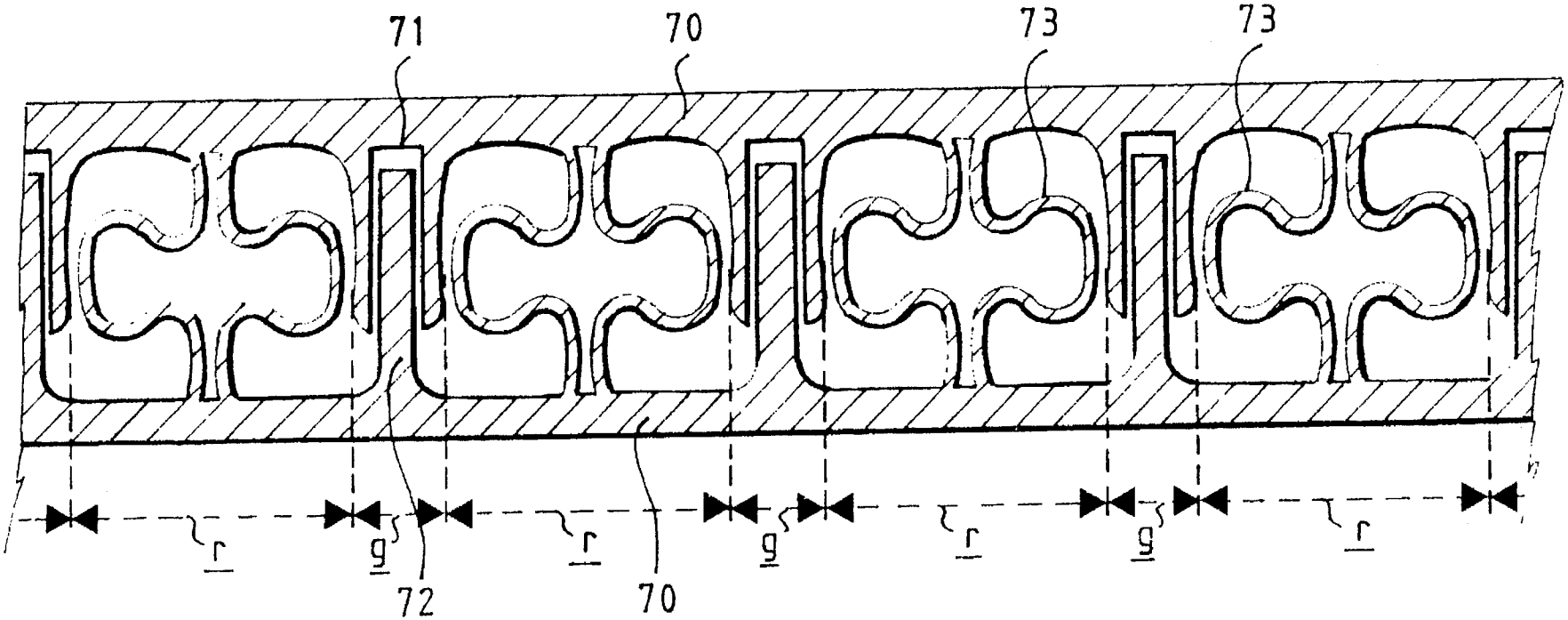
FIG. 3 shows a spread-out view of the spring used in the cathode of FIG. 2.

The spring 53 is a hollow cylinder and has solid parts and recesses. FIG. 3 shows a spread-out view of the spring 53. The shapes of the recesses are only non-restrictive examples and any other appropriate shape may be envisaged. In the figure, the hatched parts are solid.

Preferably, the spring is formed by at least one guiding portion and at least one spring portion. In the example described, the spring 53 has, transversely, a succession of portions: these are guiding portions referenced g that alternate with spring portions referenced r. The cylinder has two opposite flat edges 70 and the recesses are in its median part.

A guiding portion g may be formed by a recess demarcating a solid U-shaped part 71 within which there slides a tongue 72. The sliding is done along an axis parallel to the axis of the cylinder. The bottom of the U is formed by one of the edges 70 and the tongue is connected to the other edge.

A spring portion r may be formed by two omega-shaped narrow bands 73 placed symmetrically with respect to an axis parallel to the axis of the cylinder. Each band 73 has one end connected to an edge 70 and the other end connected to the other opposite edge 70. The two omegas are opposite to each other by their base.

The spring portions r are capable of neutralizing the tensile and compressive stresses that arise between the two plates 51, 41 when the heating is turned on or turned off suddenly.

The guiding portions g prevent the spring from inducing torsion stresses in the meshwork 4.

It is sought to give the springs as low a stiffness as possible to compensate as efficiently as possible for the stresses that arise between the two plates 41, 51.

It has been seen that the tubes 42, 52 and the plates 41, 51 were used to lead in heating current to the meshwork 4. Since graphite has a relatively high resistivity, it is preferable to short-circuit the spring 53 by a conductive element 56 to prevent a major drop in heating voltage of the meshwork 4. In FIG. 2, the conductive element 56 is represented by at least one thin conductive strip such as a metal band. It has one end fixed to the upper plate 51 and the other end fixed to the inner tube 52. It short-circuits the spring 53. It is crossed by the heating current. It is made of a material having a resistivity lower than that of the material of the spring. It is possible to use tantalum for example. The strip is given a thickness that is low enough for it to be flexible and for the stiffness of the unit formed by the conductive element and the spring to be close to that of the spring alone.

In FIG. 2, the cathode shown is meshed but the invention can also be applied to cathodes with parallel wires. The spring has been integrated with the upper support 5. It is of course possible to consider integrating it with the lower support 6. Instead of placing the spring between the elongated part and the plate, an elongated part consisting of two parts could have been used and the spring could have been interposed between the two parts.

Figure 4:
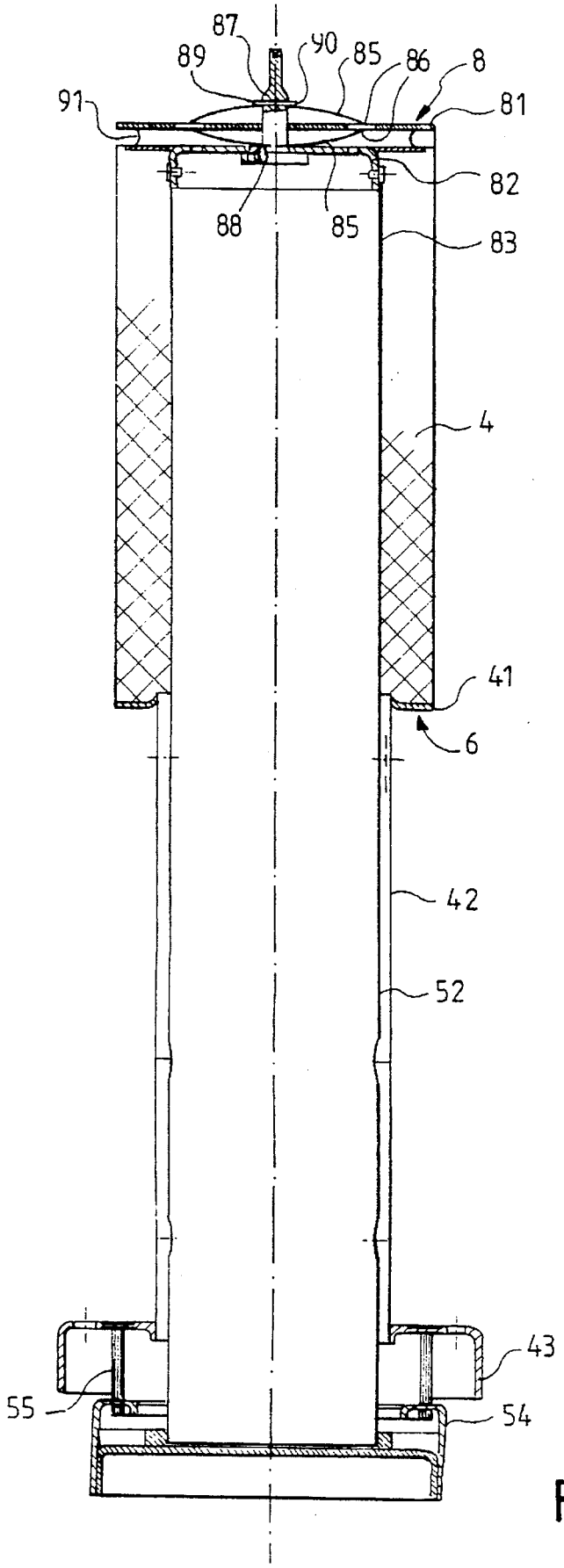
FIG. 4 shows a longitudinal sectional view of a variant of a cathode according to the invention.

FIG. 4 shows a longitudinal sectional view of a variant of a cathode according to the invention using two springs. In this example, as in FIG. 2, the cathode is a meshed cathode. FIG. 4 shows the two supports 6, 8 of the wires. There are no modifications in the lower support 6.

The upper support 8 has two ring-shaped plates 81, 82 placed one on top of the other. The meshwork 4 is fixed to the first plate which, herein, is the upper plate 81 at its external flank. The second plate which, herein, is the lower plate 82, is connected at its external flank to one end of an elongated rod-shaped or tube-shaped part 83. The other end of the elongated part 83 is fixedly joined, electrically and mechanically, to the second cathode connection part 54.

The two springs bear the reference 85. They are saucer-shaped with a central aperture and are opposite to each other by their external edges 86. They are placed on either side of the top plate 81 and their outer edges 86 rest on one of the main faces of the upper plate 81. They work in opposition. A centering rod 87 fixedly joined to the lower plate 82 crosses the two springs 85 and the upper plate 81. The inner edge 88 of the lower spring 85 rests on the lower plate 82 and the inner edge 89 of the upper spring 85 rests on a collar 90 borne by the centering rod 87. In this configuration, the springs are used to neutralize the compressive and tensile stresses that arise in the wires but the guiding function is fulfilled by the centering rod 87. The top plate 81 slides along the centering rod 87. Flexible conductive strips 91 electrically connect the top plate 81 to the bottom plate 82. They short-circuit the springs 85.

The integrating of the two springs with the lower support 6 could have been envisaged. The use of only one spring instead of two could also have been envisaged. The bottom spring would have been kept and it would have been pre-stressed.

The invention also relates to a grid electron tube comprising such a cathode. Around the cathode there is at least one grid and one anode. All the electrodes are coaxially mounted.

What is claimed is:

1. A cathode for an electron tube having a hollow cylindrical structure, comprising:

thermo-emissive wires mounted between two conductive supports, these supports being mechanically fixed to each other; and at least one spring proximal to the wires and integrated with one of the supports to neutralize the tensile and compressive stresses in the wires, wherein each of said at least one spring is made of graphite.

2. An electron tube cathode according to claim 1, wherein the graphite is pyrolytic.

3. An electron tube cathode according to claim 1, wherein the support integrating the spring comprises a plate to which there are fixed the thermo-emissive wires and an elongated part, the spring extending the elongated part by one side and being fixed by the other side to the plate.

4. An electron tube cathode according to claim 1, wherein the spring is a hollow cylinder comprising, crosswise, an alternating succession of portions comprising at least one spring portion and at least one guiding portion.

5. An electron tube cathode according to claim 4, wherein the guiding portion comprises a solid U-shaped part within which there slides a tongue having an axis parallel to the axis of the cylinder.

6. An electron tube cathode according to claim 4, wherein the spring portion comprises two omega-shaped strips that are placed symmetrically with respect to an axis parallel to the axis of the cylinder and that are opposite to each other by the base of the omegas.

7. An electron tube cathode according to claim 1, comprising two springs working in opposition.

8. An electron tube cathode according to claim 7, wherein the springs are saucer-shaped and opposite to each other by their edges.

9. An electron tube cathode according to claim 7, wherein the support integrating the springs includes two plates, one on top of the other, the first plate being connected to the thermo-emissive wires and the second plate being connected to an elongated part, one of the springs resting by one side on the second plate and by the other side on the first plate, the other spring resting by one side on the first plate and by the other side on a stop fixedly joined to the second plate.

10. An electron tube cathode according to claim 9, wherein the stop is borne by a centering rod fixed to the second plate, the centering rod passing through the springs and the first plate.

11. An electron tube cathode according to claim 1 wherein, since the supports are crossed by a heating current, a conductive element short-circuits the spring, the element having lower electrical resistivity than that of the spring.

12. An electron tube cathode according to claim 11, wherein the conductive element is formed by at least one metal band.

13. An electron tube cathode according to claim 11, wherein the conductive element is made of tantalum.

14. An electron tube cathode according to claim 11, wherein the stiffness of the conductive element is as low as possible so that the stiffness of the assembly formed by the conductive element and the spring is close to that of the spring alone.

15. A grid-type electron tube comprising a cathode according to one of the claims 1 to 13.

* * * * *